United States Patent [19]

Kamei et al.

[11] Patent Number: 4,733,478

[45] Date of Patent: Mar. 29, 1988

[54] METHOD OF DEWATERING BROWN COAL

[75] Inventors: Takao Kamei, Ashiya; Fuminobu Ono; Keiichi Komai, both of Akashi; Takeshi Wakabayashi, Kobe, all of Japan

[73] Assignee: Kawasaki Jukogyo Kabushiki Kaisha, Kobe, Japan

[21] Appl. No.: 915,800

[22] Filed: Oct. 6, 1986

[30] Foreign Application Priority Data

| | | | |
|---|---|---|---|
| Oct. 7, 1985 | [JP] | Japan | 60-223174 |
| Oct. 7, 1985 | [JP] | Japan | 60-223175 |
| Oct. 7, 1985 | [JP] | Japan | 60-223176 |

[51] Int. Cl.[4] ..... F26B 7/00

[52] U.S. Cl. ..... 34/15; 34/37

[58] Field of Search ..... 34/9, 15, 37, 86

[56] References Cited

U.S. PATENT DOCUMENTS

| | | | |
|---|---|---|---|
| 1,632,829 | 6/1927 | Fleissner | 34/37 |
| 1,679,078 | 7/1928 | Fleissner | 34/37 |
| 3,007,254 | 11/1961 | Schuster | 34/15 |
| 3,552,031 | 1/1971 | Evans et al. | 34/9 |
| 4,466,199 | 8/1984 | Nakabayashi et al. | 34/9 |
| 4,471,536 | 9/1984 | Herber | 34/9 |
| 4,472,885 | 9/1984 | Nakabayashi et al. | 34/9 |
| 4,502,227 | 3/1985 | Janusch | 34/15 |
| 4,514,910 | 5/1985 | Elmore et al. | 34/15 |
| 4,536,969 | 8/1985 | Sherman | 34/9 |
| 4,628,619 | 12/1986 | Janusch et al. | 34/9 |

FOREIGN PATENT DOCUMENTS

| | | |
|---|---|---|
| 550903 | 12/1982 | Australia . |
| 190490 | 7/1957 | Austria . |
| 58-142987 | 8/1983 | Japan . |

*Primary Examiner*—Albert J. Makay
*Assistant Examiner*—David W. Westphal
*Attorney, Agent, or Firm*—Marshall, O'Toole, Gerstein, Murray & Bicknell

[57] ABSTRACT

This disclosure relates to a process for steam dewatering of brown coal, using a plurality of autoclaves, each of which, in cyclic sequence among the autoclaves, repeats a batch process comprised of an atmospheric pressure stage to unload the coal dewatered and to load the coal to be dewatered, a heating stage to heat and dewater the loaded coal and a depressurizing stage to lower the interior pressure for the unloading of coal, wherein the heating stage comprises first and second steaming steps successive in this order at the final period of this stage to be supplied with fresh steam from an external source, and an initial steaming step under which the autoclave is connected with the other autoclave undergoing the second heating step, thereby intensifying the steam ventilation at the second heating step.

20 Claims, 13 Drawing Figures

METHOD OF DEWATERING BROWN COAL

FIELD AND BACKGROUND OF THE INVENTION

The present invention relates to a process for steam dewatering of high moisture organic solid materials, in particular, coal in its early stages of formation such as peat, brown coal, lignite and subbituminous coal.

In this specification such high moisture organic solid materials will be deemed to be included in the term "brown coal".

Since brown coal is porous and contains a large quantity of water in its capillaries, its utilization has been limited to the areas around the mine sites despite the existence of huge reserves. To use brown coal in areas remote from the mine sites, it is desirable to reduce its moisture (and therefore weight) and thereby improve the economy of transporting it.

However, the ordinary evaporative drying methods are not suitable for brown coal because it consumes a large amount of latent heat for evaporation, and the dried product is dusty and dangerous because of the possibility of spontaneous ignition or a dust explosion.

The only known prior art method suitable for brown coal is steam dewatering which was orginially disclosed by Fleissner (U.S. Pat. Nos. 1,632,829 and 1,679,078.

The original concept of steam dewatering consisted of first heating brown coal in pressurized saturated steam so as to prevent the evaporation of the moisture from coal and then reducing the steam pressure thereby making the moisture evaporate.

Later, it was discovered that a large amount of water was released from the coal without evaporation during the heating stage, because of the destruction of the colloidal structural of coal, with the result that heat consumption is small and the coal quality is upgraded during heating.

The use of hot water instead of saturated steam was disclosed by U.S. Pat. No. 3,552,031, but this process is unsatisfactory because during the depressurizing state the moisture can no longer decrease by evaporation, but in addition it even increases the moisture because the coal reabsorbs water when cooled.

An industrial process of steam dewatering was disclosed by Kretchmer (Austrian Pat. No. 190,490) employing a number of autoclaves containing brown coal and the same number of condensate tanks attached to the autoclaves (the autoclaves and the condensate tanks being connected in pairs) to receive and store the hot water (a mixture of steam condensate and moisture removed from coal) generated at each of the autoclaves.

According to this Austrian patent, when a pair consisting of an autoclave and a condensate tank conducts the depressurizing stage, there is prepared another pair of an autoclave and a condensate tank which is in an earlier portion of the heating stage, so that steam and/or hot water exhausted from the depressurizing pair flows into the heating pair and the heat is utilized to preheat the coal in the heating pair.

Another industrial process of steam dewatering is disclosed by Schuster (U.S. Pat. No. 3,007,254), but this process is uneconomical because it requires a number of accumulators in addition to the pairs of autoclaves and condensate tanks, and instead of a direct heat exchange between autoclave pairs, the exhausted steam and hot water from the depressurizing pair are first stored in accumulators and later flowed into the preheating pair.

Both of the processes disclosed by Kretchmer and Schuster can be termed a "closed heating process", because heat recovery is carried out only from the depressurizing stage and not from the heating state. This means that autoclave pairs are always closed through the entire heating stage except for the final discharge of waste water to the outside of the system.

Although the steam dewatering process disclosed by Kretchmer is the most successful prior art system, it has the following drawbacks because it is a "closed heating process":

(1) The heating of the coal is insufficient and some portion of the hot water tends to remain among the coal particles and be reabsorbed during depressurization, especially when the particle size is small, because the autoclave pairs are closed during the heating stage and steam does not readily flow through the coal beds in them.

(2) A large number of condensate tanks are required, because all of the waste heat consumed during the heating stage must be kept stored mainly in the form of hot water which is exhausted only after the beginning of the depressurizing stage as the preheating medium for other autoclave pairs during the earlier portion of heating stage.

(3) The depressurizing time is long, because a large amount of heat must be recovered, in spite of the fact that the faster the depressurization, the larger is the moisture evaporation during depressurization.

(4) The depressurizing time cannot be shortened, also because it should be equal to the time of the earlier portion of the heating stage to preheat the coal by the waste heat recovered therefrom.

(5) The average processing capacity per autoclave is small and the equipment cost becomes high, because the single batch processing time is unnecessarily long.

(6) More than two of the autoclaves forming a heat exchange group are connected with an external steam source simultaneously for a certain period, wherein a greater amount of steam tends to flow into the downstream autoclave having a lower temperature and pressure which started in the heating stage later, and the steam flow drops in the last period of heating which is most critical for dewatering, because fresh steam must be directly supplied from the external source through all of the remaining later portion of the heating stage after the heat recovery from the depressurization stage.

(7) The steam temperature does not become high enough in comparison with the adapted pressure at the end of the heating stage, because the partial steam pressure is lowered by the presence of the noncondensible gas decomposed from the coal by the heat. There is a known art method to draw off the gas at the final portion of the heating stage, but it is incomplete, dangerous and accompanied by a considerable steam loss.

The process step which comprises the heat recovery from the heating stage can be called the "ventilating heating process", because steam flows through the autoclave during the heating stage and waste heat is recovered therefrom simultaneously.

The concept of the "ventilating heating process" has already been disclosed by some of the present inventors and other people in Japanese Patent Provisional Publication No. 58-142987 laid open on Aug. 25, 1983. However, the disclosed process is not sufficient to eliminate the drawbacks of the conventional closed heating process, because it discloses only the process of eliminating the problems of the residual inner-particle water, wherein brown coal is enclosed in a plurality of pressure vessels, superheated steam is fed into the first pressure vessel to dewater the coal, the saturated steam or nearly-saturated steam is discharged from the vessel, and fed into the second pressure vessel or vessels to effect saturated steam dewatering of the coal therein. The above disclosure does not teach which period of the heating stage the waste heat should be recovered from nor passed to, and from which autoclave to which autoclave the heat should be recovered. Since then, the disclosure does not indicate a way to utilize the "ventilating heating" to solve the problems of the "closed heating process".

It is an object of the present invention to provide a steam dewatering process for brown coal with high dewatering performance and low equipment cost, by eliminating the aforementioned drawbacks of the conventional closed heating process.

Another object of the present invention is to provide a steam dewatering process for brown coal, wherein ventilating heating is carried out effectively.

SUMMARY OF THE INVENTION

According to the present invention, the above and other objects are accomplished by a process for steam dewatering of brown coal, using a number of autoclaves, each of which, in cyclic sequence among the autoclaves, repeats a batch operation comprised of (1) an atmospheric pressure stage to unload the coal dewatered and to load the coal to be dewatered.

(2) a heating stage to heat and dewater the loaded coal and (3) a depressurizing stage to lower the interior pressure for the unloading of coal.

wherein the heating stage comprises first and second steaming steps successive in this order at the final period of this stage to be supplied with fresh steam from an external source, and an initial steaming step under which the autoclave is connected with the other autoclave undergoing the said second steaming step, thereby intensifying the steam ventilation at the second steaming step.

In a preferable mode of the present invention, the batch operation is common to all of the used autoclaves both in the constitution of steps and in the length of its cycle time, wherein 1/N of the single batch cycle time is the interval between the two autoclaves which are successive in the cyclic sequence, and the total time of the first and second steaming steps is equal to 1/N of the single batch cycle time, where N is the number of the autoclaves, whereby only one autoclave is supplied with fresh steam simultaneously.

The initial steaming step may be just before the first steaming step, but there may be a suitable number of intermediate steaming steps between the initial and the first steaming steps depending on the required steaming time which depends on the kind of coal and the product moisture level.

In the embodiment of the present invention wherein there is no intermediate steaming step, each of the autoclaves is not connected with any other autoclave at the first steaming step, and then it is connected directly with the autoclave next in the cyclic sequence at the second steaming step, thereby conducting the initial steaming step in the said next autoclave.

According to the above embodiment of the present invention, (1) closed heating by recovered steam is carried out at the initial steaming step (2) closed heating by fresh steam is carried out at the first steaming step, and (3) ventilating heating by fresh steam is carried out at the second steaming step.

In the other embodiment of the present invention wherein there are a suitable number of intermediate steaming steps, each of the autoclaves is connected with one or more succeeding autoclaves in series in accordance with the cyclic sequence at the first steaming step, thereby conducting intermediate steaming steps in the autoclaves connected in series, and then is connected with the autoclave next to the series via the series at the second steaming step, thereby continuing the intermediate steaming steps in the series autoclaves and conducting the inital steaming steps in the next autoclaves.

According to the above embodiment of the present invention, (1) closed heating by recovered steam is carried out at the initial steaming step and at the earliest of the intermediate steaming steps, (2) ventilating heating by recovered steam is carried out at the remaining intermediate steaming steps, and (3) ventilating heating by fresh steam is carried out at the first and the second heating steps According to the present invention the heating of the coal is sufficient because fresh steam is ventilated through the coal bed and expels the hot water retained in the bed at the final period of the heating stage. The fresh steam may be saturated steam, but more preferably superheated steam which evaporates the retained hot water and becomes a saturated steam source for the next autoclave; therefore the effective combination of saturated steam dewatering and superheated steam dewatering can be carried out by a single external steam source. It is preferable that the fresh steam is supplied into the upper portion of the autoclave in the second steaming step, flows downward and is discharged from a lower portion of the autoclave, because the downward steam flow expels more hot water than upward flow.

According to the present invention some of the waste heat during the heating stage can be utilized simultaneously as the preheating medium for the earlier portion of the heating stage.

It is possible to carry out the present invention by connecting each of the autoclaves with the condensate tank which is attached to it to form an autoclave pair through all the period as in the prior art. However, the autoclave can be isolated from the condensate tank paired with it during the ventilating heating since the hot water generated at this period can be transferred to the next autoclave.

The autoclave can be isolated from the condensate tank paired with it also during the depressurizing stage and atmospheric pressure stage as is disclosed in Japanese Patent Provisional Publication No. 57-57795 laid open on Apr. 7, 1982, wherein the condensate tank is depressurized separately with the paired autoclave.

The autoclave can be isolated from the condensate tank paired with it also during the steps in the heating stage earlier than the initial steaming step except for the step of final discharge of the waste water to the outside of the system, because the hot water generated during these steps is not so much and can be expelled at either of the steps of the said final discharge of the waste water or of the said initial steaming, provided that the autoclave is connected with a condensate tank at the initial steaming step.

The autoclave can be isolated from the condensate tank paired with it also at the step of the final discharge of waste water to the outside of the system, providing each of the autoclaves is equipped with the means to discharge water directly to the outside of the system, because the water generated at this step no longer needs to be stored.

According to the present invention the number of condensate tanks to be connected to the autoclave can be lower than the number of autoclaves, because the time period when an autoclave is paired with a condensate tank can be made short as mentioned above.

The present invention can be carried out by connecting an autoclave with a condensate tank even only in the two steps of closed steaming (the initial steaming step and the next step which is either of the first intermediate steaming step or the first steaming step), wherein only two condensate tanks are needed.

According to the present invention, the heat to be released during the depressurizing stage can be made smaller and the time for the depressurizing stage can be made shorter than conventional processes, because at the beginning of the depressurizing stage the heat recovery is partially finished by the ventilating heating and the temperature of the hot water in the paired condensate tank is lowered.

In the embodiment of the present invention wherein the autoclaves are disconnected with the condensate tanks at the depressurizing stage, the depressurizing time can be made especially shorter.

According to the present invention the steaming period can be made sufficiently long without making the fresh steam supplying period long, and the drop of steam flow rates at the last period of the heating stage can be avoided.

According to the present invention the single batch cycle time can be made shorter, because of the shortening of the depressurizing time and the sufficient steaming.

According to the present invention the temperature and the partial pressure is not lowered by the remaining coal decomposed gas which cannot be drawn off by the conventional incomplete method.

It is also possible to draw off the gas at an earlier period of the heating stage instead of the final portion of the heating stage as in the conventional process, because the gas is completely transferred to the next autoclave by the ventilating heating at the said second steaming step.

In extreme conditions, any independent procedure for drawing off the decomposed gas can be omitted by exhausting the gas with the waste water at the step of the final discharge of waste water.

BRIEF DESCRIPTION OF THE DRAWINGS

The above and other objects and features of the present invention will be more apparent from the following detailed description of preferred embodiments of the invention, taken with reference to the accompanying drawings, wherein.

DETAILED DESCRIPTION OF THE DRAWINGS

Figure 1:
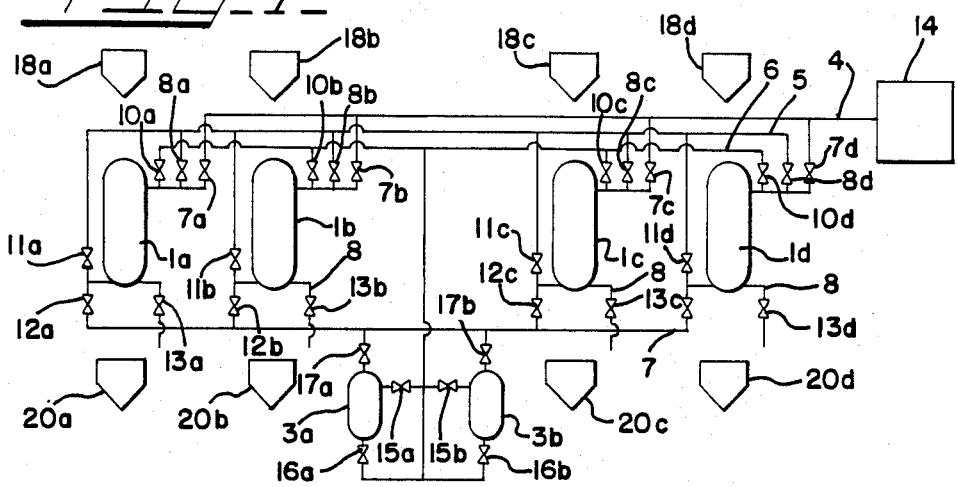
FIG. 1 is a schematic diagram of a preferred embodiment of the brown coal dewatering system according to the present invention.

According to the preferable embodiment of the present invention shown in FIG. 1, the system includes four autoclaves 1*a*–1*d* having substantially the same construction, and two condensate tanks 3*a*–3*b* having substantially the same construction. The autoclaves 1*a*–1*d* are adapted to be loaded with feed coal from bunkers 18*a*–18*d*, respectively, and to be unloaded with dewatered coal into bunkers 20*a*–20*d*, respectively.

An external superheated steam source 14, such as a boiler, is connected by pipe 4 to the upper portions of the autoclaves 1*a*–1*d* respectively through valves 7*a*–7*d*. The upper portions of the autoclaves 1*a*–1*d* are connected by pipe 5 together respectively through valves 8*a*–8*d* in parallel, and also by pipe 6 through valves 10*a*–10*d*.

The lower portions of the autoclaves 1*a*–1*d* are piped respectively through valves 11*a*–11*d* to the common line 5 leading to the valves 8*a*–8*d*. The lower portions of the autoclaves 1*a*–1*d* are also connected together by pipe 7 respectively through valves 12*a*–12*d* in parallel, and connected by pipes 8 to the outside respectively through valves 13*a*–13*d*.

The common line 7 to the valves 12*a*–12*d* is piped through valves 17*a*–17*b* respectively to upper portions of the condensate tanks 3*a*–3*b*. The common pipe 6 to the valves 10*a*–10*d* is piped through valves 15*a*–15*b* respectively to the upper portion of the tanks 3*a*–3*b*, and through valves 16*a*–16*b* respectively to lower portions of the tanks 3*a*–3*b*.

Figure 2:
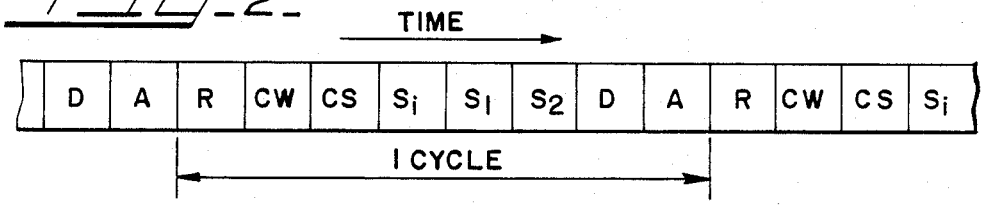
FIG. 2 is a time chart for a single batch operation of each autoclave shown in FIG. 1.

Each of the four autoclaves 1*a*–1*d* repeats a batch operation of steam dewatering of brown coal. As shown in FIG. 2, the single cycle of the batch operation consists sequentially of:

(1) a heating stage including
- a preheating step R with steam from a depressurizing autoclave,
- a preheating step CW with hot water from a depressurizing condensate tank,
- a preheating step CS with steam from a depressurizing condensate tank,
- an initial steaming step Si with steam from a heating autoclave,
- a first steaming step S1 with fresh steam, and
- a second steaming step S2 with fresh steam;

(2) a depressurizing stage D, and (3) an atmospheric pressure stage A comprising the steps of unloading and loading coal.

Figure 3:
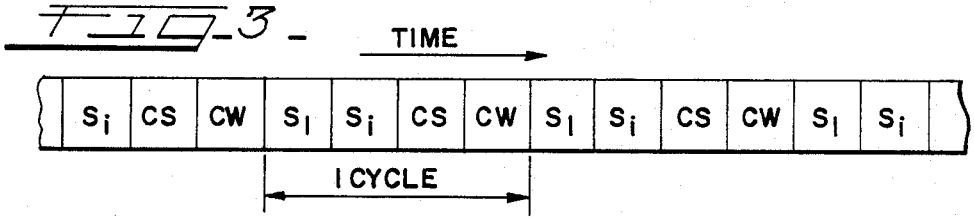
FIG. 3 is a time chart for a single batch operation of each condensate tank shown in FIG. 1.
Figure 4:
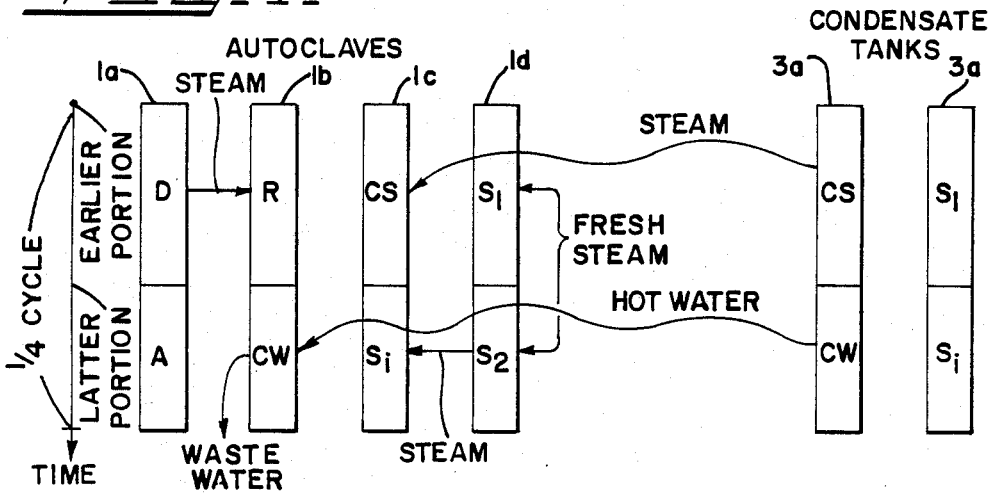
FIG. 4 is a time chart for the system of FIG. 1, showing ¼ the period of the single batch cycle of an autoclave.

As shown in FIG. 3, each of the two condensate tanks 3*a* and 3*b* repeats a cycle of operation which comprises (1) a heating stage to receive and store hot water including
  a step to be paired with an autoclave at step S1 and
  a step to be paired with an autoclave at step Si and
(2) a depressurizing stage including
  a step CS to evaporate the stored hot water and exhaust the steam and
  a step CW to exhaust the remaining hot water Each of the four autoclaves 1*a*–1*d* repeats the batch operation in cyclic sequence among the autoclaves with the interval of ¼ of the single batch cycle time, a shown in FIG. 4 wherein the relation between the operations of the four autoclaves is expressed for a certain period of ¼ of the single batch cycle time.

The operation of the two condensate tanks 3*a* and 3*b* have each other the interval of ¼ of the single batch cycle time of autoclaves, as also shown in FIG. 4. Therefore the cycle time of condensate tanks is 2/4, i.e. ½ of that of the autoclaves.

Figure 5:
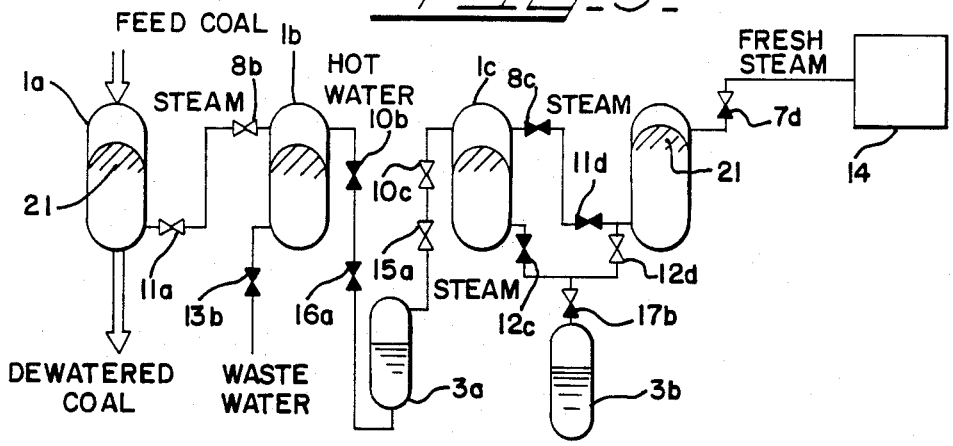
FIG. 5 is a partial schematic diagram of the system shown in FIG. 1, showing only the parts relating to FIG. 4.

Of the system shown in FIG. 1, the part which relates to the period shown in FIG. 4 is illustrated in FIG. 5 for the convenience of explanation. In FIG. 5, the white valves are open in the earlier portion of the quarter cycle period of the autoclave operation shown in FIG. 4, the all black valves are open in the latter portion, and the half-white and half-black valves are open throughout the entire quarter cycle.

With reference to FIGS. 4–5, the earlier portion of the quarter period of the autoclave operation is as follows. The autoclave 1*d* has just completed the initial steaming step Si, and has been filled with high-pressure saturated steam (SS).

An external steam source 14, such as a boiler, supplies superheated steam (SHS) into the autoclave 1*d* in the first steaming step S1 through the valve 7*d*. As the pressure in the autoclave 1*d* is already high, the amount of superheated steam flowing into it is small. As the saturated steam inside the autoclave 1*d* heats the coal 21 and condenses, just enough superheated steam flows in to compensate for the amount of the condensed steam. The superheated steam is soon saturated by the saturated steam and hot water both already being present in the autoclave 1*d*. Therefore this is substantially a closed saturated steam heating step. The hot water produced in this step flows down into the condensate tank 3*b* through the valves 12*d* and 17*b*, and is stored in it.

The autoclave 1*a* has just completed the final heating step S2, and the autoclave 1*b* has just become loaded with feed coal.

The steam in the autoclave 1*a* at the depressurizing stage D moves to the autoclave 1*b* at the preheating step R through the valves 11*a* and 8*b*. This depressurizes the autoclave 1*a* and preheats the autoclave 1*b*.

The autoclave 1*c* has just completed the preheating step CW, and the condensate tank 3*a* has just completed the receipt of hot water in the step Si.

In the preheating step CS, the tank 3*a* is depressurized through the valves 15*a* and 10*c*, and a portion of the hot water flashes. The flashing steam flows into the autoclave 1*c* and further preheats the coal in it.

The hot water generated during the preheating steps R and CS is not drained from the coal, but stored in the bottom of the autoclaves. In these steps, the storage of hot water together with the coal poses no problems; it is rather advantageous because the time of contact between the coal and water is longer to improve the heat exchange.

The later portion of the quarter period will be explained. The autoclave 1*a* has just reached atmospheric pressure at the end of depressurizing stage D. In the step A, the dewatered coal is unloaded from the autoclave 1*a*, and feed coal is loaded into it.

The autoclave 1*b* in the preheating step CW is connected through the valves 10*b* and 16*a* to the lower portion of the tank 3*a*, which has been partially cooled and depressurized. As a result, the hot water flows from the tank 3*a* into the autoclave 1*b*, and the tank 3*a* is depressurized further. The water then passes through the coal layer in the autoclave 1*b* to preheat it, and it ends up as waste water at a temperature of 100 degrees C. (at the highest 150 degrees C.) or under, which is then drained through the valve 13*b*.

The autoclave 1*d* in the second steaming step S2 continues to be supplied with superheated steam, and its lower portion is connected via the valves 11*d* and 8*c* to the downstream autoclave 1*c*. A large quantity of superheated steam flows into the upper portion of the autoclave 1*d*, and passes downward through the coal bed to effect ventilating superheated steam heating. The moisture which has been oozed out of the coal by the saturated steam heating in the step S1 and has formed water films over the surfaces of the coal in the autoclave 1*d*, evaporates quickly.

The autoclave 1*d* in this step S2 discharges saturated steam from its lower portion to heat the coal in the autoclave 1*c* in the step Si by saturated steam heating and effect nonevaporative dewatering. The downward steam flow through the coal layer in the autoclave 1*d* improves the dewatering performance by purging the inter-particle water from the coal.

The autoclave 1*d* in the step S2 becomes superheated, and the contact between the steam and coal is enhanced. The gases decomposed from the coal in the autoclave 1*d* are exhausted into the downstream autoclave 1*c*. This raises the partial pressure of the steam and the temperature in the autoclave 1*d*. The water bound between the coal particles is evaporated and reduced in quantity.

At this time, in the autoclave 1*c*, water is removed in liquid form from the coal due to the heating by saturated steam discharged from the autoclave 1*d*.

Subsequently in the earlier portion of the next quarter of the autoclave cycle, the autoclave 1*c* will enter into the first steaming step S1, where superheated steam is supplied. However, the autoclave 1*c* will be kept in the closed condition, and the saturated steam environment will continue prevailing in the autoclave as described previously with regard to the upstream autoclave 1*d*. Therefore, the coal in the autoclave will further be dewatered without evaporation.

In the next step, the autoclave 1*c* will enter the final heating step S2, where superheated steam dewatering, as explained for the autoclave 1*d*, will be effected. The hot water produced in the autoclave 1*c* in the step Si is discharged through the valves 12*c* and 17*b* into the tank 3*b*, and stored in it.

In the next quarter period of the autoclave batch cycle, each autoclave shifts to the step undergone by the preceding autoclave in the earlier portion of the quarter period. Each condensate tank is connected to any one of the autoclaves to receive and store the hot water drained from the autoclave in each of the only two steps S1 and S2. The condensate tanks 3a–3b undergo the operation undergone by each other in the previous quarter period of the autoclave operation. It is therefore sufficient to provide only two condensate tanks for four autoclaves in the system. The hot water produced in the autoclave in the step CS is stored in itself and is drained into the condensate tank in the following step Si and stored in it. This water will be eventually discharged out of the system together with other water in the step CW.

It has been experimentally found that the absence of the gas drawing-off in the final heating step S2 does not result in any drop in the system temperature nor a drop in the dewatering performance even if the fresh steam is saturated steam. Since the gas drawing-off is not required in the highest temperature period, dangers and steam loss are small.

Thus, the coal decomposed gases need not be removed in the step S2, but are discharged with the steam to the step Si, wherein they may be removed. If the gases are not removed in the step Si, they will accumulate over the liquid in the associated tank, and be sent to the autoclave in the steps CS and CW, wherein they may be removed. If the gases are not removed at all, they will be released together with the waste water from the autoclave in the step CW, and they do not affect the dewatering performance. However, when the smell of the gases is a problem, the gases should be removed in some of the intermediate steps.

Providing that the number of the autoclaves in the system is N, fresh steam is supplied from the outside of the system for only 1/N of the period of the autoclave operation cycle. This eliminates the necessity of supplying two or more autoclaves with fresh steam simultaneously. The amount of steam flowing into the autoclave is greater in the final heating step S2 than in each of the earlier heating steps Si and S1. In the most important heating step S2, the steam can pass through the coal bed at a sufficient flow rate. Even if this fresh steam is saturated steam, not to mention superheated steam, the heating and dewatering is sufficient in comparison with the conventional closed heating.

The destination of steam exhausted from the heating step S2 is fed to the selected succeeding autoclave. This allows the plural autoclaves in the system to operate efficiently. It is the event that, even if fresh steam is supplied for such a short period of the 1/N cycle time, the heat recovery from the upstream steaming steps assures a sufficient steaming time.

In the final heating step S2, it is not necessary to store any of the hot water. The hot water produced in the autoclave 1d in the step S2 is sent to the downstream autoclave 1c with the steam, and the upstream autoclave 1d requires no condensate tank. It is possible to recover heat from a condensate tank independently of the depressurization of an autoclave. In this way, the depressurizing time of the autoclave can be freely shortened, without being restrained much by the preheating time; depressurization can be made in a time shorter than 1/N of the cycle period. Thus, the one batch processing time can be programmed without any redundancy, and the cost of equipment can be reduced significantly.

The second to the seventh embodiments of the present invention are described as follows, referring to the drawings of FIGS. 6–11 respectively showing the time chart of each embodiment for the 1/N period of the single batch cycle time, since this type of chart can express both the step constitution of one batch cycle and the relation between the steps as shown in FIG. 4.

Figure 6:
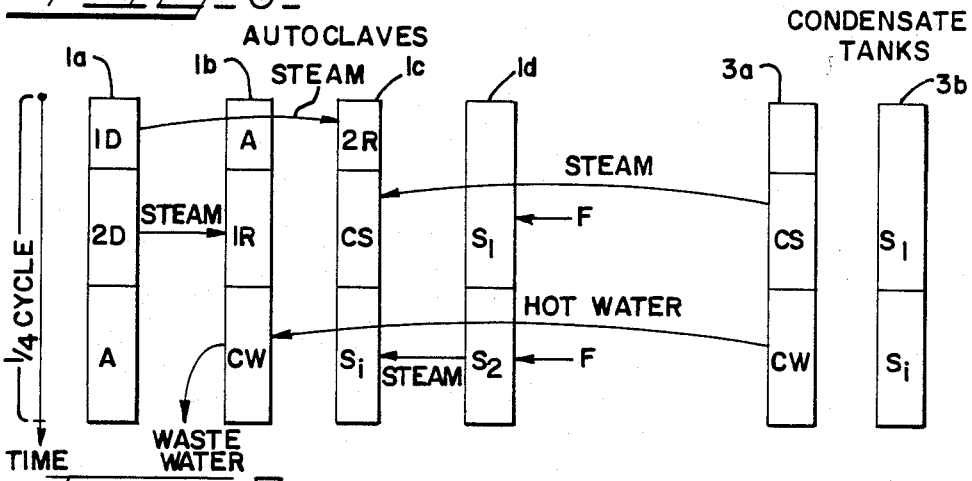
FIGS. 6–11 are time charts of additional embodiments of the invention.
Figure 7:
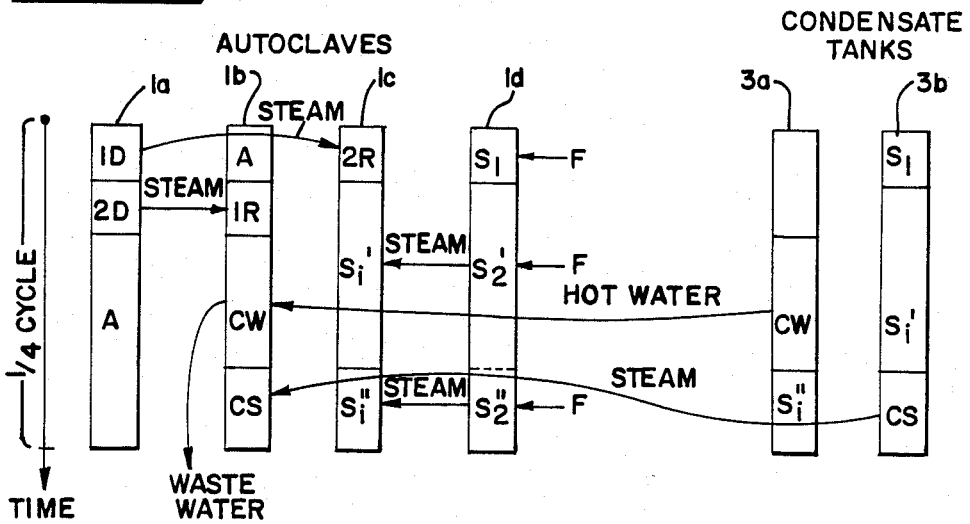

In FIG. 6, two depressurization steps 1D and 2D are associated with two preheating steps 2R and 1R, respectively, to improve the heat receovery of the waste steam from the depressurizing autoclave. F denotes the fresh steam:

In FIG. 7, the first depressurization step 1D is achieved by the connection to the autoclave in the second preheating step 2R, which has just completed the recovery of the condensate tank steam (CS). In this case, as the connection is made to the autoclave in the step 1D of higher pressure, the depressurizing time is less quick, but the heat recovery from the depressurizing autoclave, and in turn the thermal efficiency, are improved in comparison with the system of FIG. 6. In this case, the initial steaming step Si is divided into two substeps of Si' and Si'', because the condensate tank to be paired with it is changed during the step Si. The steaming step S2 is also divided into two substeps of S2' and S2''. The steam ventilation is further intensified in the substep S2'', because the associated downstream autoclave of the substep Si'' is connected with lower pressure condensate tank.

Figure 8:
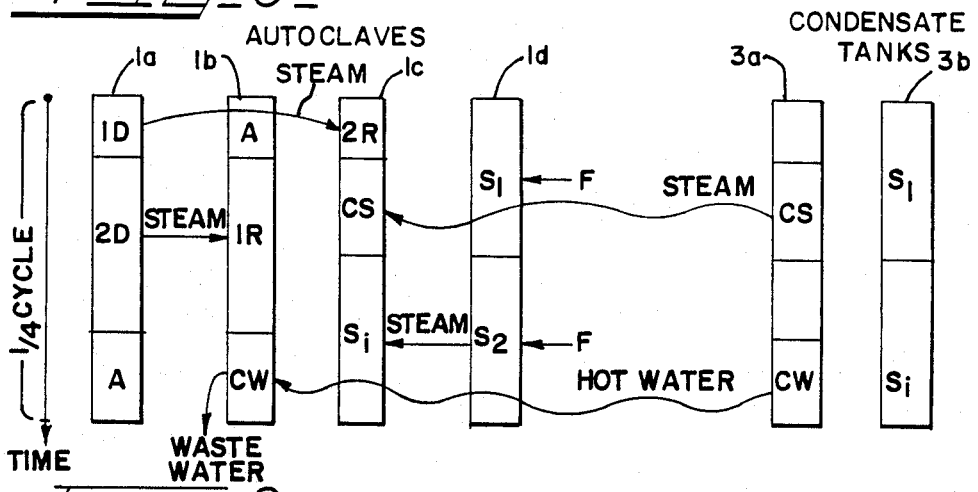
Figure 9:
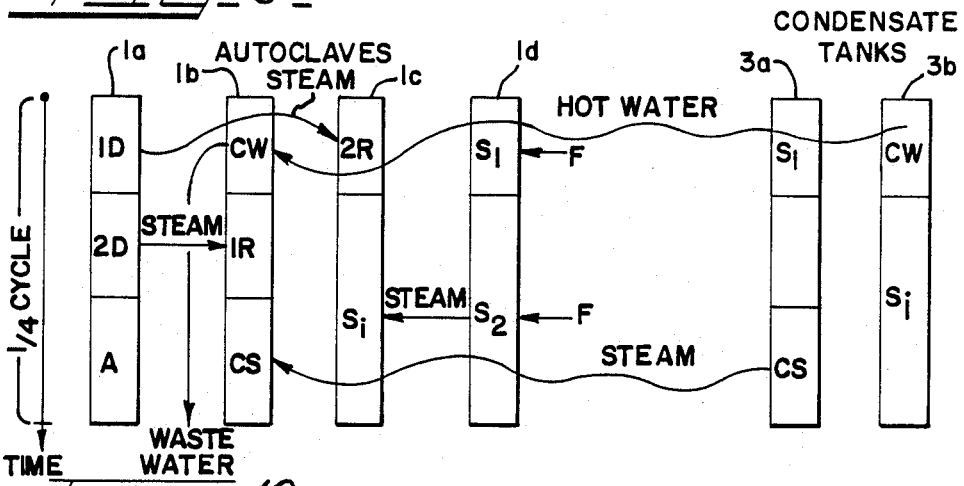

FIG. 8 shows a method for improving the heat recovery of the steam by allowing a sufficient time for the second depressurization step 2D. Fig. 9 shows a method for preheating CW with hot water prior to preheating 1R with depressurized waste steam. A large quantity of waste hot water flows in to wash the feed coal and prevent the waste water pipe from clogging. It also raises the heat recovery rate of the hot water and the thermal efficiency.

Figure 10:
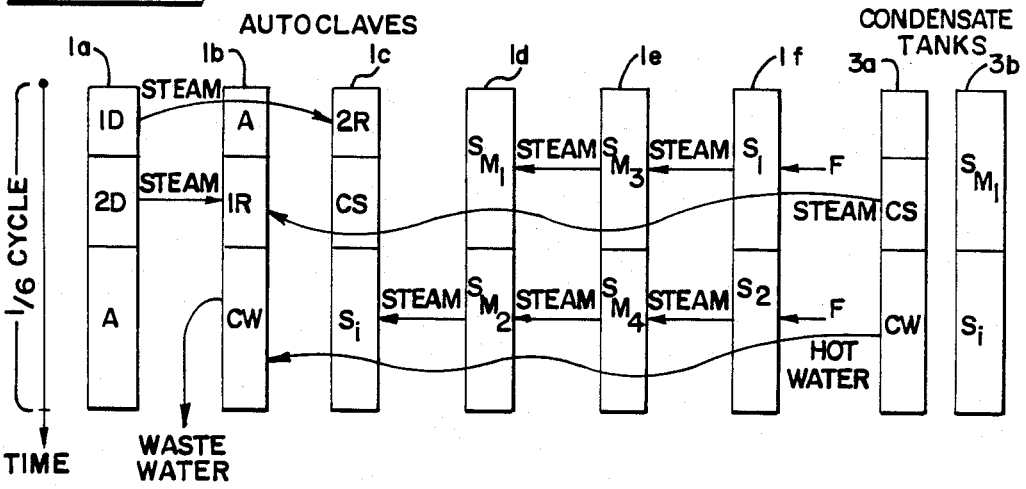

FIG. 10 shows an embodiment including a set of six autoclaves 1a–1f, wherein there are four steps of intermediate steaming $Sm_1$, $Sm_2$, $Sm_3$ and $Sm_4$. According to this method the steaming time can be made long without overlapping the fresh steam supply to more than two autoclaves. Also, the number of connected autoclaves is increased to enhance the inter-particle water purging effect, and the system is arranged to enhance the inter-particle water evaporation effect when superheated steam is supplied as fresh steam F not only at step $S_2$ but also at step $S_1$. For example, in the earlier portion of the 1/6 cycle period in FIG. 10, fresh steam F is supplied to the autoclave 1f, which discharges steam into the succeeding autoclave 1e. Simultaneously, this autoclave 1e discharges steam into the succeeding autoclave 1d to effect ventilating heating in the former autoclave 1e.

This increases the amount of fresh steam flowing into the most preceding autoclave 1f, wherein the heating and dewatering is further improved. When the fresh steam is superheated steam, a high degree of superheat is maintained in this autoclave 1f.

Figure 11:
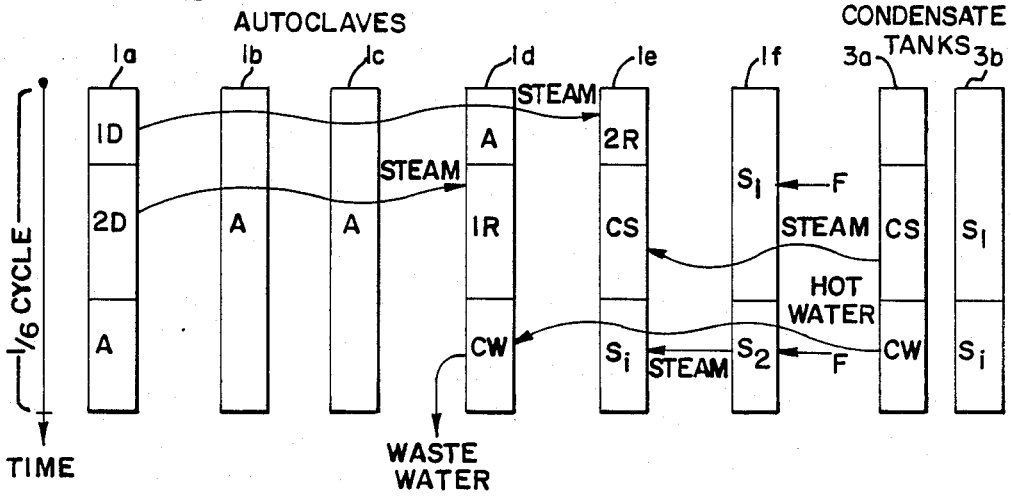

FIG. 11 shows a method which is suited to brown coal of relatively good heating characteristics and low moisture content. The heating stage is short compared with the atmospheric pressure stage, and so the single batch cycle time can be reduced.

EXAMPLE

Figure 12:
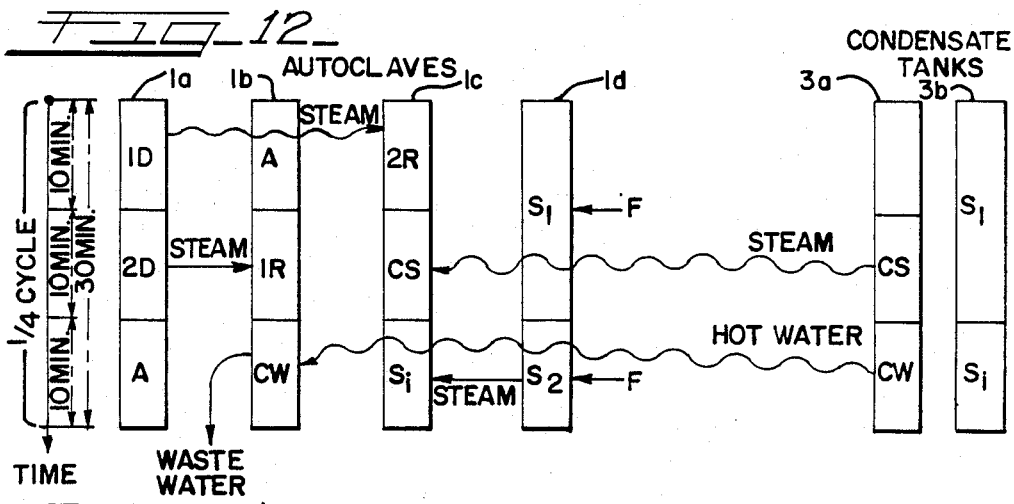
FIG. 12 is a time chart illustrating an example according to the present invention.

A dewatering system comprising four autoclaves and four condensate tanks was used to conduct a dewatering operation according to the time chart of FIG. 12. However, only two of these four condensate tanks were used. The longer the time that the atmospheric pressure stage is allowed for the discharge of the dewatered coal from the autoclaves and the loading of the feed coal, the easier the operation is. The step A was set at 20 minutes. It had been proposed to raise the dewatering performance by quick depressurization (1D+2D) as disclosed in the Japanese Patent/Provisional Publication No. 57-57794. The time was appropriated according to the proposal, and the depressurization time was set at 20 minutes, allowing a quick depressurization. The experimental conditions and the results were as shown in the left-hand column of the following table.

| Item | Example | Control |
|---|---|---|
| Kind of feed coal | Victoria coal of Australia | Victoria coal of Australia |
| Feed coal moisture | 65.5% | 65.5% |
| Supply steam | 45 kg/cm$^2$ SS | 45 kg/cm$^2$ SS |
| Steam supply time | 30 minutes | 60 minutes |
| Coal discharging & loading time | 20 minutes | 20 minutes |
| Depressurization time | 20 minutes | 40 minutes |
| Single batch processing time | 120 minutes | 160 minutes |
| Processing capacity per batch | 350 kg/batch | 350 kg/batch |
| Processing capacity per autoclave | 175 kg/hr | 131 kg/hr |
| Relative processing capacity | 1.33 | 1.0 |
| Moisture of dewatered coal | 23.4% | 26.9% |

CONTROL

Figure 13:
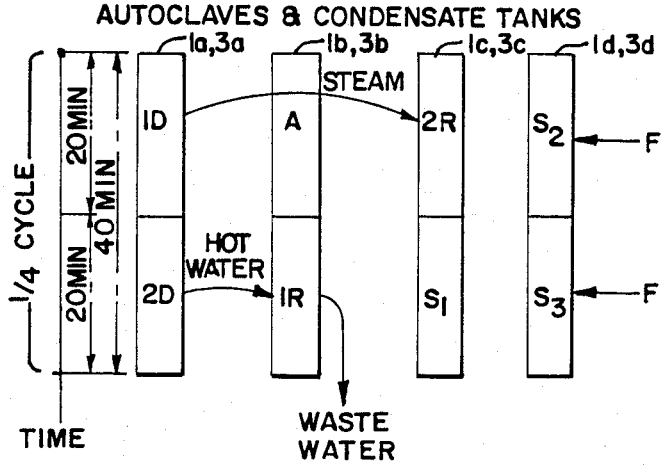
FIG. 13 is a time chart illustrating a conventional process used as a control for comparison with the example of FIG. 12.

The same dewatering system as the above Example was used to conduct the dewatering operation according to the time chart of FIG. 13. However, all of the four condensate tanks were used. The depressurization time was 40 minutes. The experimental conditions and the results were as shown in the right-hand column of the above table.

The aforementioned results indicate that in the conventional process, the period 1D and the period A should coincide with each other, as shown in the time chart of FIG. 13, and the waste steam and hot water exhausted from the depressurization stage must be recovered as the heat source for the preheating of another autoclave. In other words, it has such defects that the total depressurization time (1D and 2D) is larger than the coal discharging and loading time (A) and the quick depressurization cannot be affected, and that if the quick depressurization is unnaturally made in a short time (for a part of the period 1D), the plant cannot be utilized effectively since the autoclaves are not used for some time, and the temperature of the coal cannot rise smoothly.

According to the method of the present invention, it was possible to shorten the overall processing time by programming the step constitution of the single batch operation preferably wherein the autoclaves were used all the time.

As shown by the aforementioned results of the experiments, according to the method of the present invention, the overall processing time was shortened and, moreover, the dewatering preformance was improved. For systems of the same size, it was confirmed that the plant capacity was raised by 33% or over. The reasons for the improvement in the dewatering performance were, first, the depressurization time was shortened to 20 minutes and the depressurization was effected quickly, as mentioned above, and secondly, the external steam supply was made for $\frac{1}{4}$ of the 120-minute cycle, and the waste steam from the second steaming step $S_2$ was introduced in the initial steaming step Si so that steam was conducted through the autoclave in $S_2$ to sufficiently raise the temperature of the brown coal. In this connection, in the experiment of the conventional method, the total heating stage (from 1R to $S_3$) was 100 minutes while in the experiment of the method of the present invention, the total heating stage (from 1R to $S_2$) was only 80 minutes. The same coal discharging and loading time was used in both experiments for operability. If it is sufficient to reduce the moisture level to that of the conventional method, the single batch cycle time of the method of the present invention can be reduced further.

The system preferably also includes a conventional hydraulic, electric, etc. control system (not shown) for automatically operating the valves, feeding and unloading the coal, etc. While the system is theoretically operable with two autoclaves, it is preferable to have three or more autoclaves.

What is claimed is:

1. A process for steam dewatering of brown coal, using a plurality of autoclaves, each of which, in cyclic sequence among the autoclaves, repeats a batch process comprised of:

(1) atmospheric pressure stage to unload the coal dewatered and to load the coal to be dewatered;

(2) heating stage to heat and dewater said loaded coal; and (3) depressurizing stage to lower the interior pressure for said unloading of coal, wherein said heating stage comprises S2, an initial steaming step Si, a first steaming step S1 after said step Si, and a second steaming step S2 immediately after the said step S1 and at the end of said heating stage, the autoclaves in both said steps S1 and S2 being supplied with fresh steam from an external source, each said autoclave in said step Si being connected to said autoclave in the step S2, so that the steam flows from the latter to the former, thereby intensifying the steam ventilation at said step S2.

2. A process according to claim 1, wherein said batch operation is common to all of said used autoclaves both in the constitution of steps and in the length of its cycle time, 1/N of the one batch cycle time being the interval between each two autoclaves successive in the said cyclic sequence, and the total time of said steps S1 and S2 is equal to 1/N of the single batch cycle time, where N is the number of said autoclaves, whereby only one autoclave is supplied with fresh steam simultaneously.

3. A process according to claim 1, wherein there is no intermediate steaming step between said step Si and said step S1, each of the said autoclaves at said step S1 being unconnected with any other autoclaves, and then at said step S2 is connected directly with the autoclaves next in said cyclic sequence, thereby conducting said step Si in said next autoclaves.

4. A process according to claim 3, wherein the fresh steam is supplied into the upper portion of the autoclave in said step S2, flows downward and is discharged from a lower portion of said autoclave.

5. A process according to claim 1, wherein there are a plurality of intermediate steaming steps between said step Si and said step S1, each of said autoclaves at said step S1 being connected with one or more autoclaves in series in accordance with said cyclic sequence, thereby conducting intermediate steaming steps in said connected autoclaves in series, and then at said step S2 is connected with the autoclave next to said series via the said series, thereby continuing the intermediate steaming steps in said series autoclaves and conducting said step Si in said next autoclaves.

6. A process for steam dewatering of brown coal, using a plurality of autoclaves, each of which, in cyclic sequence among the autoclaves, repeats a batch process comprised of:

(1) atmospheric pressure stage to unload the coal dewatered and to load the coal to be dewatered;
(2) heating stage to heat and dewater said loaded coal; and
(3) depressurizing stage to lower the interior pressure for said unloading of coal, wherein said heating stage comprises an initial steaming step Si, a first steaming step S1 after said step Si, and a second steaming step S2 immediately after said step Si and at the end of said heating stage, the autoclaves in both said steps S1 and S2 being supplied with fresh steam from an external source, the autoclave in said step Si is being connected to the autoclave in the said step S2, so that the steam flows from the latter to the former, thereby intensifying the steam ventilation already in the claim at said step S2, said batch operation being common to all of said used autoclaves both in the constitution of steps and in the length of its cycle time, 1/N of the one batch cycle time being the interval between each two autoclaves successive in the said cyclic sequence, and the total time of said steps S1 and S2 is equal to 1/N of the single batch cycle time, where N is the number of said autoclaves, whereby only one autoclave is supplied with fresh steam simultaneously, there being no intermediate steaming step between said step Si and said step S1, each of the said autoclaves at said step S1 being unconnected with any other autoclaves, and then each of said autoclaves at said step S2 is connected directly with the autoclave next in said cyclic sequence, thereby conducting said step Si in said next autoclaves.

7. A process for steam dewatering of brown coal, using a plurality of autoclaves, each of which, in cyclic sequence among the autoclaves, repeats a batch process comprised of:

(1) atmospheric pressure stage to unload the coal dewatered and to load the coal to be dewatered;
(2) heating stage to heat and dewater said loaded coal; and
(3) depressurizing stage to lower the interior pressure for said unloading of coal, wherein said heating stage comprises an initial steaming step Si, a first steaming step S1 after said step Si, and a second steaming step S2 immediately after the said step S1 and at the end of the heating stage, the autoclaves in both the said steps S1 and S2 are supplied with fresh steam from an external source, the autoclave in the said step Si is connected to the autoclave in the said step S2, so that the steam flows from the latter to the former, thereby intensifying the steam ventilation at said step S2, said batch operation being common to all of said used autoclaves both in the constitution of steps and in the length of its cycle time, 1/N of the one batch cycle time being the interval between each two autoclaves successive in the said cyclic sequence, and the total time of said steps S1 and S2 is equal to 1/N of the single batch cycle time, where N is the number of said autoclaves, whereby only one autoclave is supplied with fresh steam simultaneously, there being a plurality of intermediate steaming steps between said step Si and said step S1, each of said autoclaves at said step S1 being connected with one or more autoclaves in series in accordance with said cyclic sequence, thereby conducting intermediate steaming steps in said connected autoclaves in series, and then at said steps S2 is connected with the autoclave next to said series via the said series, thereby continuing the intermediate steaming steps in said series autoclaves and conducting said step Si in said next autoclaves.

8. A process according to any of claims 3, 6, 5 and 7, wherein the fresh steam from an external source is superheated steam, whereby the combination of saturated steam dewatering and superheated steam dewatering is carried out by a single steam source.

9. A process according to any of claims 3, 6, 5 and 7, wherein the autoclave under said step S2 is not connected with a condensate tank to receive and store the hot water therefrom.

10. A process according to any of claims 5 and 7, wherein the autoclave under said intermediate steaming steps is not connected with a condensate tank to receive and store the hot water therefrom, except under the first of said steps when said autoclave is connected at the most downstream of said series with the autoclave under said step S1.

11. A process according to any of claims 3, 6, 5 and 7, wherein the autoclave under said depressurizing stage and said atmospheric pressure stage is not connected with a condensate tank to receive and store the hot water therefrom.

12. A process according to any of claims 3, 6, 5 and 7, wherein said autoclave under the heating stage earlier than step Si is not connected with a condensate tank to receive and store the hot water therefrom, except under the step to discharge waste water finally to the outside of the system.

13. A process according to any of claims 3, 6, 5 and 7, wherein providing each of said autoclaves with a means to discharge water directly to the outside of the system, the autoclave under the step of discharging waste water finally to the outside of the system is not connected with a condensate tank to receive and store the hot water therefrom.

14. A process according to any of claims 3, 6, 5 and 7, wherein the number of said condensate tanks for receiving and storing the hot water generated in said autoclaves under said heating stage is less than the number of said autoclaves.

15. A process according to any of claims 3, 6, 5 and 7, wherein the noncondensible gas decomposed from coal by heating is not drawn off to the outside of the system from the autoclave under said second steaming step.

16. A process according to claim 15, wherein said gas is not drawn off independently at any period of the batch operation but is exhausted with the final waste water to the outside of the system.

17. A process for steam dewatering of brown coal, using a plurality of autoclaves, each of which, in cyclic sequence among the autoclaves, repeats a batch process comprised of:

(1) atmospheric pressure stage to unload the coal dewatered and to load the coal to be dewatered;
(2) heating stage to heat and dewater said loaded coal; and
(3) depressurizing stage to lower the interior pressure for said unloading of coal, wherein said heating stage comprises first and second steaming steps successive to this order at the final period of this stage to be supplied with fresh steam from an external source, and an initial steaming step under which the autoclave is connected with the other autoclave undergoing said second steaming step, thereby intensifying the steam ventilation at said second steaming step, wherein there is no intermediate steaming step between said initial steaming step and said first steaming step, each of the said autoclaves at said first steaming step being unconnected with any other autoclaves, and then at said second steaming step is connected directly with the autoclave next in said cyclic sequence, thereby conducting said initial steaming step in said next autoclaves, and there are two said condensate tanks for receiving and storing the hot water generated in said autoclaves and either of these said condensate tanks is only connected to said autoclaves only at said initial steaming step and the steaming step next to said step.

18. A process for steam dewatering of brown coal, using a plurality of autoclaves, each of which, in cyclic sequence among the autoclaves, repeats a batch process comprised of:

(1) atmospheric pressure stage to unload the coal dewatered and to load the coal to be dewatered;

(2) heating stage to heat and dewater said loaded coal; and (3) depressurizing stage to lower the interior pressure for said unloading of coal, wherein said heating stage comprises first and second steaming steps successive in this order at the final period of this stage to be supplied with fresh steam from an external source, and an initial steaming step under which the autoclave is connected with the other autoclave undergoing said second steaming step, thereby intensifying the steam ventilation at said second steaming step, said batch operation being common to all of said used autoclaves both in the constitution of steps and in the length of its cycle time, 1/N of the one batch cycle time being the interval between each two autoclaves successive in the said cyclic sequence, and the total time of said first and second steaming steps is equal to 1/N of the single batch cycle time, where N is the number of said autoclaves, whereby only one autoclave is supplied with fresh steam simultaneously, there being no intermediate steaming step between said initial steaming step and said first steaming step, each of the said autoclaves at said first steaming step being unconnected with any other autoclaves, and then at said second steaming step is connected directly with the autoclaves next in said cyclic sequence, thereby conducting said initial steaming step in said next autoclaves, there are two said condensate tanks for receiving and storing the hot water generated in said autoclaves, and either of these said condensate tanks is connected to said autoclaves only at said initial steaming step and in the steaming step next to said step.

19. A process for steam dewatering of brown coal, using a plurality of autoclaves, each of which, in cyclic sequence among the autoclaves, repeats a batch process comprised of:

(1) atmospheric pressure stage to unload the coal dewatered and to load the coal to be dewatered;

(2) heating stage to heat and dewater said loaded coal; and (3) depressurizing stage to lower the interior pressure for said unloading of coal, wherein said heating stage comprises first and second steaming steps successive in this order at the final period of this stage to be supplied with fresh steam from an external source, and an initial steaming step under which the autoclave is connected with the other autoclave undergoing said second steaming step, thereby intensifying the steam ventilation at said second steaming step, wherein there are a plurality of intermediate steaming steps between said initial steaming step and said first steaming step, each of said autoclaves at said first steaming step being connected with one or more autoclaves in series in accordance with said cyclic sequence, thereby conducting intermediate steaming steps in said connected autoclaves in series, and then at said second steaming steps is connected with the autoclave next to said series via the said series, thereby continuing the intermediate steaming steps in said series autoclaves and conducting said initial steaming step in said next autoclaves, and there are two said condensate tanks for receiving and storing the hot water generated in said autoclaves, and either of these said condensate tanks is connected to said autoclaves only at said initial steaming step and the steaming step next to said step.

20. A process for steam dewatering of brown coal, using a plurality of autoclaves, each of which, in cyclic sequence among the autoclaves, repeats a batch process comprised of:

(1) atmospheric pressure stage to unload the coal dewatered and to load the coal to be dewatered;

(2) heating stage to heat and dewater said loaded coal; and (3) depressurizing stage to lower the interior pressure for said unloading of coal, wherein said heating stage comprises first and second steaming steps successive in this order at the final period of this stage to be supplied with fresh steam from an external source, and an initial steaming step under which the autoclave is connected with the other autoclave undergoing said second steaming step, thereby intensifying the steam ventilation at said second steaming step, said batch operation being common to all of said used autoclaves both in the constitution of steps and in the length of its cycle time, 1/N of the one batch cycle time being the interval between each two autoclaves successive in the said cyclic sequence, and the total time of said first and second steaming steps is equal to 1/N of the single batch cycle time, where N is the number of said autoclaves, whereby only one autoclave is supplied with fresh steam simultaneously, there being a plurality of intermediate steaming steps between said initial steaming step and said first steaming step, each of said autoclaves at said first steaming step being connected with one or more autoclaves in series in accordance with said cyclic sequence, thereby conducting intermediate steaming steps in said connected autoclaves in series, and then at said second steaming steps is connected with the autoclave next to said series via the said series, thereby continuing the intermediate steaming steps in said series autoclaves and conducting said initial steaming step in said next autoclaves, and there are two said condensate tanks for receiving and storing the hot water generated in said autoclaves, and either of these said condensate tanks is connected to said autoclaves only at said initial steaming step and the steaming step next to said step.

* * * * *